United States Patent [19]

Horikawa

[11] Patent Number: 4,799,313

[45] Date of Patent: Jan. 24, 1989

[54] APPARATUS FOR THREADING A SLIDER ONTO OPPOSED STRINGERS FOR SLIDE FASTENER

[75] Inventor: Yoichi Horikawa, Kurobe, Japan

[73] Assignee: Yoshida Kogyo K. K., Tokyo, Japan

[21] Appl. No.: 151,644

[22] Filed: Feb. 2, 1988

[30] Foreign Application Priority Data

Feb. 3, 1987 [JP] Japan ..... 62-24341

[51] Int. Cl.[4] ..... A41H 37/06

[52] U.S. Cl. ..... 29/768; 29/408

[58] Field of Search ..... 29/768, 766, 33.2, 408, 29/409

[56] References Cited

U.S. PATENT DOCUMENTS 4,604,782 8/1986 Kawakami et al. ..... 29/768

FOREIGN PATENT DOCUMENTS 2042062 9/1980 United Kingdom ..... 29/768

*Primary Examiner*—P. W. Echols

*Attorney, Agent, or Firm*—Hill, Van Santen, Steadman & Simpson

[57] ABSTRACT

An apparatus for threading a slider onto a pair of stringers of a slide fastener comprises a slider holder disposed in a longitudinal path of the opposed stringers, an aligning member disposed downstream of the slider holder for laterally aligning respective leading ends of the opposed stringers with each other which stringers have been threaded through the slider, and a clamp disposed between the slider holder and the aligning member for holding the opposed stringers in their aligned position. The clamp and the slider holder are relatively movable away from each other along the longitudinal path to draw the opposed stringers from the slider until endmost fastener elements are coupled.

15 Claims, 7 Drawing Sheets

APPARATUS FOR THREADING A SLIDER ONTO OPPOSED STRINGERS FOR SLIDE FASTENER

BACKGROUND OF THE INVENTION

1. Field of the Invention

The present invention relates to an apparatus for threading a slider onto a pair of opposed stringers for a slide fastener.

2. Description of the Prior Art

For attaching a slide fastener to a garment, it is a known practice in garment making to sew a pair of fastener stringers onto the garment and then to thread the pair of fastener stringers through a slider while the latter is held in place by a tool. At that time respective leading end portions, which are devoid of fastener elements, of the two fastener stringers are threaded through the slider from a front flared end thereof, and then the respective leading ends of the opposed stringers are laterally aligned with each other, whereupon the opposed stringers are drawn from the slider with the leading ends of the stringers firmly held by hand in their aligned position.

A primary problem with this conventional technology is that divergence in coupling the opposed stringers would often occur especially if the slide fastener is the type shown in FIG. 11 of the accompanying drawings in which the slide fastener has a so-called separable bottom stop composed of male and female stop halves mounted on the opposed stringers at the respective bottom end portions of the opposed rows of fastener elements. This is partly because the two stringers are different in resistance to passing through the slider due to the different configurations of the male and female stop halves, and partly because manual holding of the leading ends of the stringers is inadequate to maintain them in their aligned position. In order to correct such miscoupling of the opposed stringers, it is necessary to remove the top stops from the respective stringers, then to remove the stringers from the slider, and finally to separate the opposed stringers for rethreading. However, the top stops of the slide fastener of FIG. 11 are mounted on the stringers by injection-molding and hence are not easy to remove. Even if the injection-molded top stops were removed, such slide fastener would be unrecoverably defective.

SUMMARY OF THE INVENTION

It is therefore an object of the present invention to provide an apparatus for threading a slider onto a pair of stringers of a slide fastener with smooth and correct coupling of the opposed stringers even if the slide fastener has a separable bottom stop.

According to the present invention, an apparatus for threading a slider onto a pair of stringers for a slide fastener comprises: a slider holder disposed in a longitudinal path of the pair of stringers; aligning means disposed downstream of the slider holder in the longitudinal path of the stringers for laterally aligning respective leading ends of the opposed stringers with each other which stringers have been threaded through the slider; and a clamp disposed between the slider holder and the aligning means for holding the opposed stringers in their aligned position, the clamp and the slider holder being relatively movable away from each other along the longitudinal path of the stringers.

Many other advantages, features and additional objects of the present invention will become manifest to those versed in the art upon making reference to the detailed description and the accompanying sheets of drawings in which certain preferred structural embodiments incorporating the principle of the present invention are shown by way of illustrative example.

DETAILED DESCRIPTION

Figure 1:
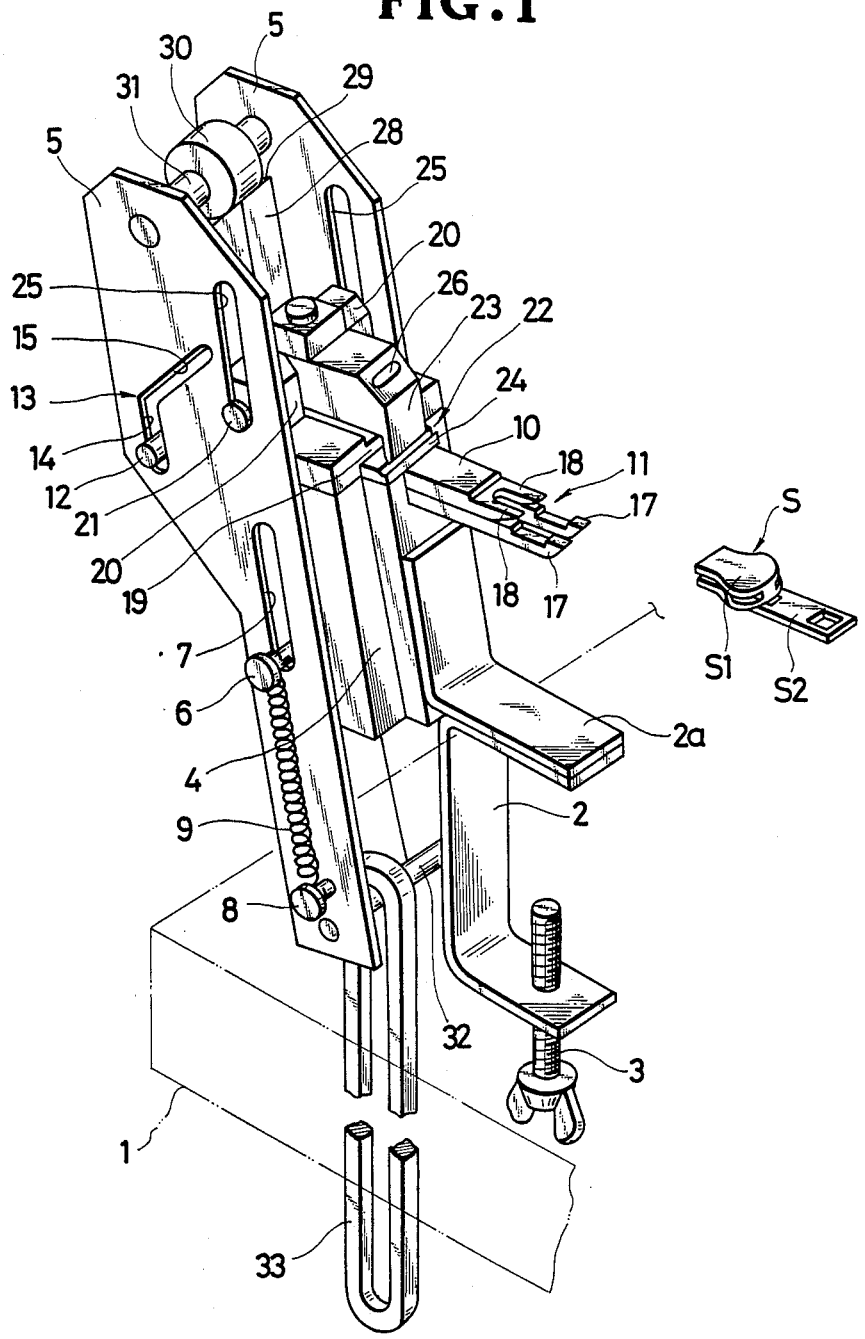
FIG. 1 is a perspective view of a slider threading apparatus according to a first embodiment of the present invention.
Figure 2:
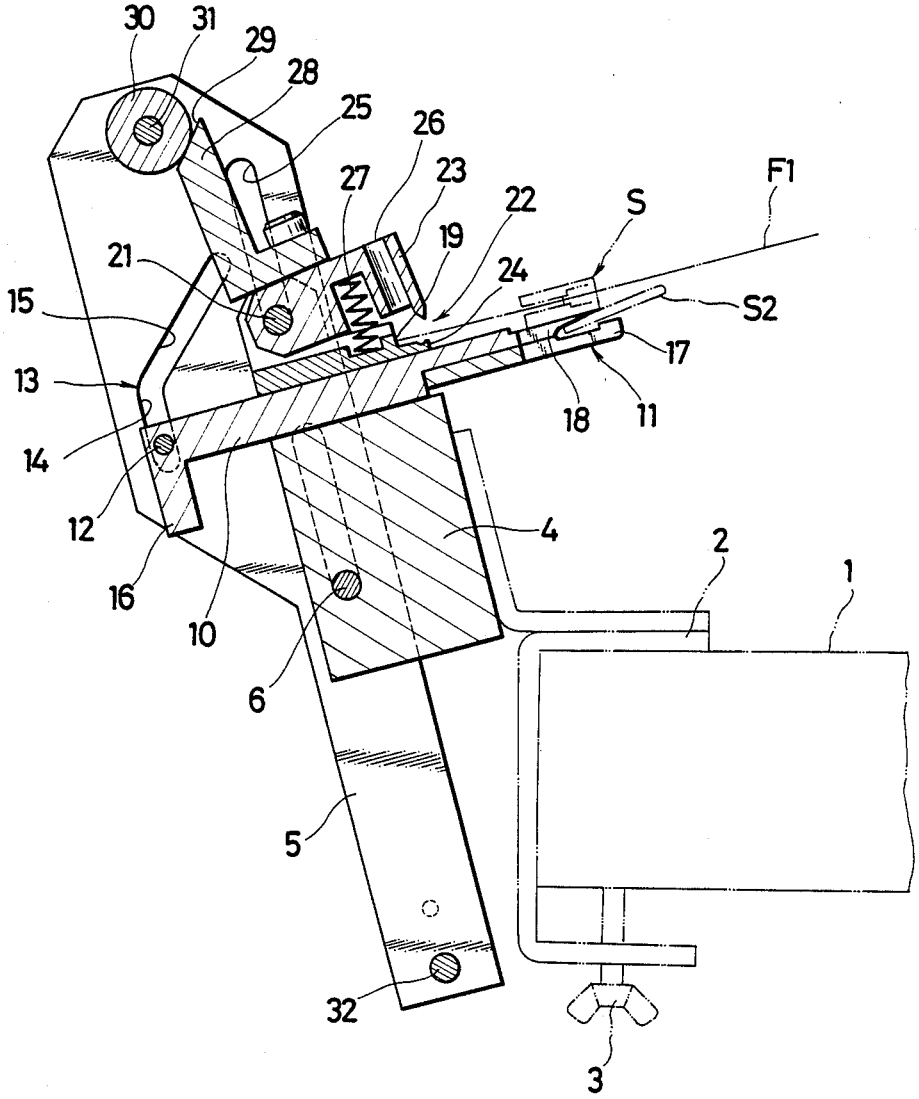
FIG. 2 is a vertical cross-sectional view of FIG. 1, showing the relative position of various parts in which leading ends of opposed stringers are laterally aligned.

FIGS. 1 and 2 show a slider threading apparatus according to a first embodiment of the present invention.

Figure 6:
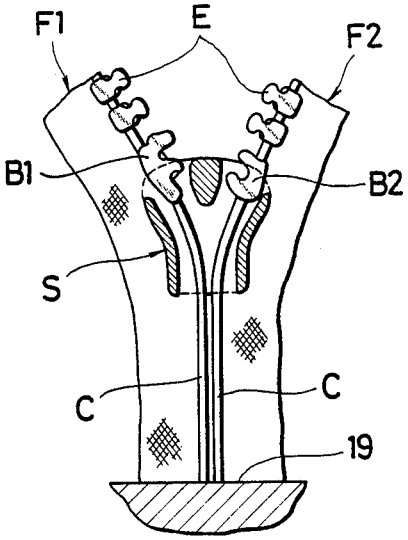
FIG. 6 is a fragmentary plan view of the opposed stringers having been threaded through the slider with their respective leading ends being laterally aligned.
Figure 7:
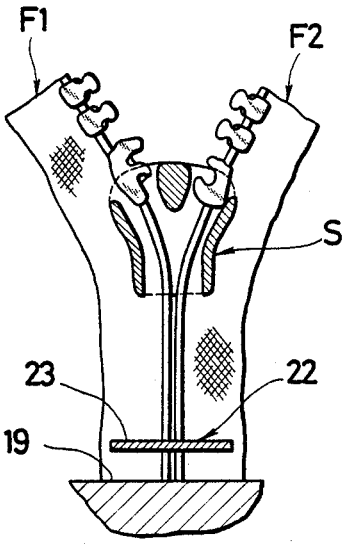
FIG. 7 is a view similar to FIG. 6, showing the manner in which the aligned leading ends of the stringers are clamped.
Figure 8:
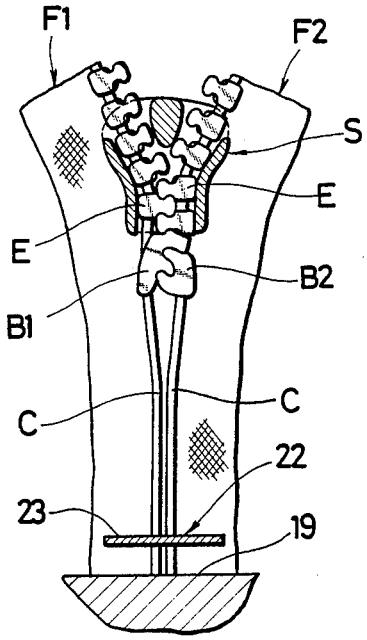
FIG. 8 is a fragmentary plan view of the opposed stringers being progressively coupled.

The apparatus generally comprises a slider holder 11 disposed in a longitudinal path of a pair of opposed stringers F1, F2 for a slide fastener F for retaining a slider S (FIG. 5) which is to be threaded onto the opposed stringers, F1, F2, a stringer aligning means 19 disposed downstream of the slider holder 11 in the longitudinal path for laterally aligning a pair of leading ends of the opposed stringers F1, F2 threaded through the slider S (FIG. 6), and a clamp 22 disposed between the slider holder 11 and the stringer aligning means 19 for holding the aligned leading portions of the opposed stringers F1, F2 in their relative position (FIG. 7). With the leading end portions of the opposed stringers F1, F2, being clamped, the slider holder 11 and the clamp 22 are relatively movable away from each other along the longitudinal path to draw the opposed stringers F1, F2 from the slider S until male and female halves B1, B2 of a separable bottom stop and at least endmost fastener elements E, E are coupled (FIG. 8). In this embodiment, the stringer aligning means 19 and the clamp 22 are stationary, and the slider holder 11 is movable away from the stringer aligning means 19 and the clamp 22 along the longitudinal path.

In use, the apparatus is adapted to be attached to a table 1 by means of a generally C-shaped member 2 and a screw 3.

The apparatus further includes a base 4 secured to the C-shaped member 2 with the medium of an angled support plate *2a* with a slant with respect to the vertical toward the side remote from the table 1. The stringer aligning means 19 is in the form of a stepped portion formed on a top of the base 4 and having an upright surface against which the leading ends of the opposed stringers F1, F2 abut.

The clamp 22 includes upper and lower clamp members 23, 24. The upper clamp member 23 pivotally mounted on a pivot 21 supported by a pair of brackets 20, 20 formed on the top of the base 4. The lower clamp member 24 is formed on the top of the base 4 at a position between the stringer aligning means 19 and the slider holder 11 and has a transverse groove toward which a tip end of the upper clamp member 23 is moved as the upper clamp member 23 is pivotally moved downwardly. A compression spring 27 is mounted between the base 4 and the upper clamp member 23 to normally urge the latter upwardly. The upper clamp member 23 has an aperture 26 through which the workperson can observe or watch the leading ends of the opposed stringers F1, F2 being aligned.

A mechanism for pivotally moving the upper clamp member 23 downwardly includes an upright projection 28 extending from an upper surface of the upper clamp member 23 and having on its top end and also on its downstream side a cam surface 29, and a follower roller 30 engageable with the cam surface 29. The follower roller 30 is mounted on a shaft 31 supported by a pair of parallel cam plates 5, 5 which are disposed one on each side of the base 4 for virtually vertical movement.

The two parallel cam plates 5, 5 have a pair of horizontally aligned vertical slots (hereinafter called first slots) 7, 7. A pair of first pins 6, 6 are mounted on the base 4 and are movably received in the two first vertical slots 7, 7 respectively. A second pin 8 is mounted on each cam plate 5 at a lower end portion thereof; an extension spring 9 is mounted between the first and second pins 6 and 8 to normally urge each cam plate 5 upwardly.

The two cam plates 5, 5 also have a pair of second slots 25, 25 similar to the first slots, 7, 7; the opposite ends of the pivot 21 are movably received in the second slots 25, 25, respectively. The degree of inclination of the first and second slots 7, 25 is equal to that of the base 4.

The slider holder 11 provided at one end of an elongated slide 10 extending through the upper portion of the base 4 perpendicularly to the inclined longitudinal axis of the base 4. The two cam plates 5, 5 have a pair of cam slots 13, 13. A pair of follower pins 12, 12 are mounted on the other end of the slide 10 and are movably received in the cam slots 13, 13, respectively. Each cam slot 13 is of a dogleg shape having a lower portion 14 parallel to the first and second slots 7, 25, and an upper portion 15 inclined toward the second slot 25.

As the two cam plates 5, 5 are moved downwardly from the position of FIGS. 1 and 2 by pulling a rope 33 hung from a bar 32 extending between the lower ends of the two cam plates 5, 5, each follower pin 12 initially moves in the lower portion 14 of the cam slot 13 toward the junction of the upper and lower portions 15, 14 (FIG. 3), keeping the slide 10 in its retracted position. With continued downward movement of the cam plates 5, 5, each follower pin 12 then moves in the upper portion 15 toward the second slot 25 (FIG. 4), causing the slide 10 to move to its advanced position. This advancing movement of the slide 10 is restricted by a stop 16 which is provided on the other end of the slide 10 and which is engageable with the base.

Figure 3:
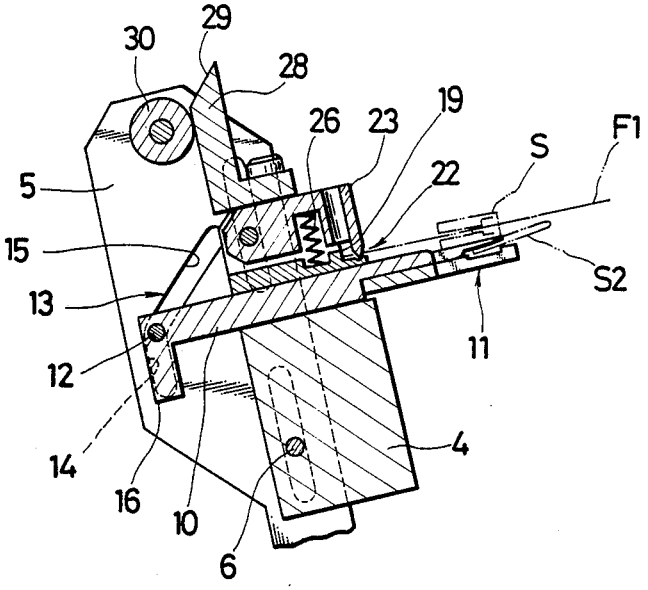
FIG. 3 is a fragmentary cross-sectional view of the apparatus, showing the relative position of various parts in which the aligned leading ends of the opposed stringers are clamped.
Figure 4:
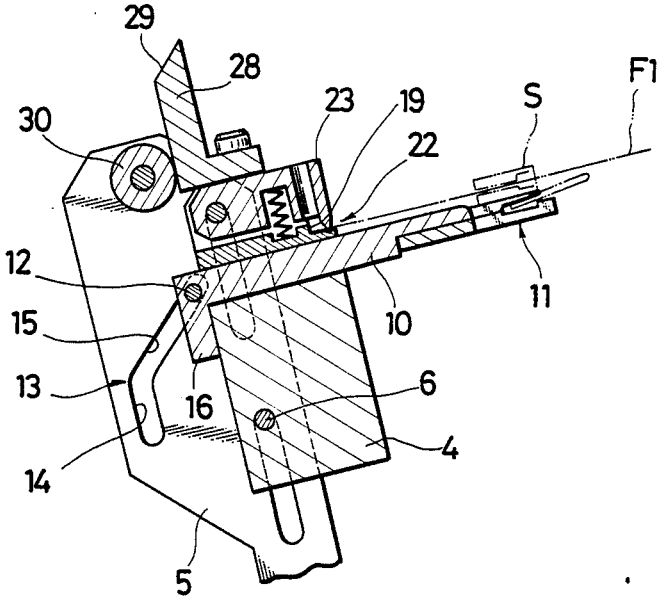
FIG. 4 is a view similar to FIG. 3, showing a slider holder in advanced position remote from a clamp.

The slider holder 11 is adapted for retaining an automatic lock slider S in unlocked position. The slider holder 11 includes a bifurcated support member 17 for supporting the slider S upside down, and a bifurcated wedge-shaped member 18 disposed immediately above the support member 17. The wedge-shaped member 18 is insertable between the slider body S1 and the pull tab S2, as shown in FIGS. 2, 3 and 4, for retracting a locking pawl (not shown) of the slider S from a fastener-element guide channel (not shown) so that the opposed stringers F1, F2 can be threaded through the slider body S1.

The distance between the aligning means 19 and the slider holder 11 in retracted position is such that the male and female bottom stop halves B1, B2 are not coupled yet when the leading ends of the opposed stringers F1, F2 threaded through the slider S abut against the aligned means 19, as shown in FIG. 6.

From the position of FIGS. 6 and 7, the slider holder 11 with the slider S retained thereon are movable away from the aligning means 19 until the male and female bottom stop halves B1, B2 and at least endmost fastener elements E, E are coupled, as shown in FIG. 8.

Figure 5:
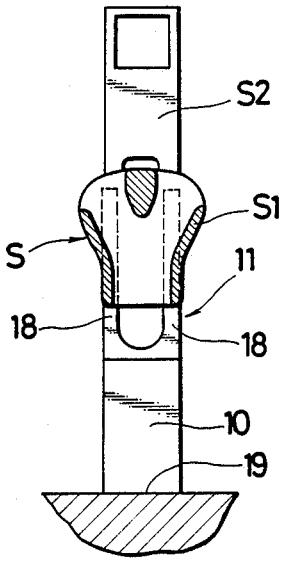
FIG. 5 is an enlarged plan view of the slider holder, showing the manner in which a slider is held in the slider holder.

In operation, the slider S is supported upside down on the slider holder 11 as shown in FIG. 5. Then the opposed stringers F1, F2 are threaded through the slider S from the front flared end thereof until the leading ends of the stringers F1, F2 abut against the aligning means 19, as shown in FIGS. 2 and 6, at which time the male and female bottom stop halves B1, B2 are not coupled yet. Subsequently, as the two cam plates 5, 5 are moved downwardly, the clamp 22 holds the aligned leading end portions of the opposed stringers F1, F2 across their inner beaded tape edges C, C, as shown in FIG. 7. With continued downward movement of the cam plates 5, 5, the slider holder 11 with the slider retained thereon is moved away from the clamp 22 (FIG. 4) until the male and female bottom stop halves B1, B2 and several endmost fastener elements E, E are coupled as shown in FIG. 8.

Thereafter, when the downward pulling force is removed from the cam plates 5, 5, they are moved upwardly under the biasing force of the extension spring 9. As a result, the slide 10 is returned to its retracted position, and then the upper clamp member 23 is returned to its raised position.

Figure 9:
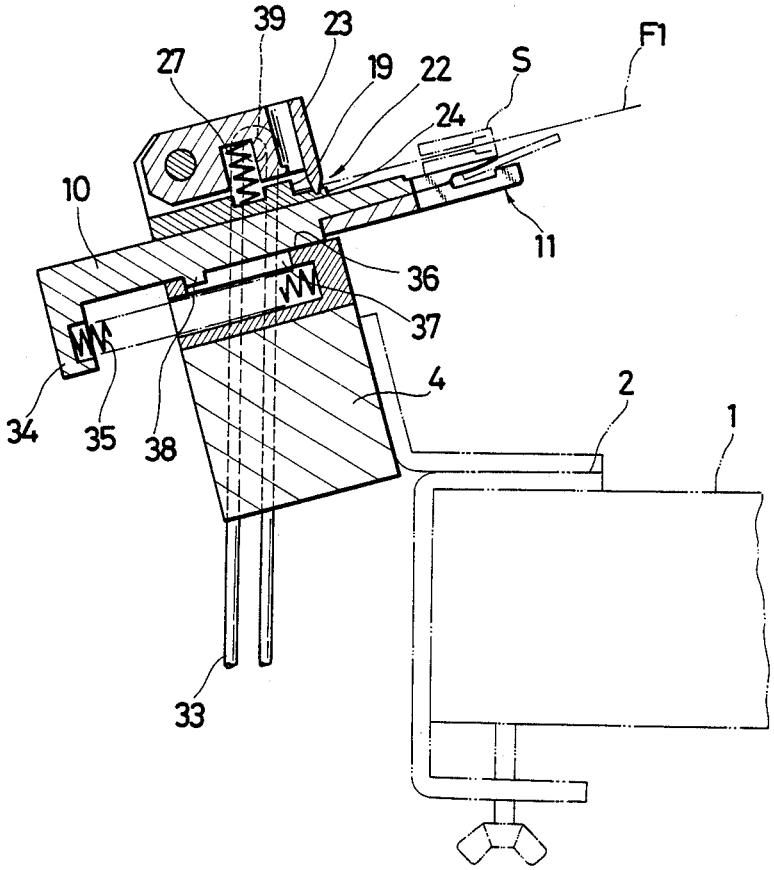
FIG. 9 is a vertical cross-sectional view of a slider threading apparatus according to a second embodiment.

FIG. 9 shows a second embodiment which is similar to the first embodiment except that the clamping of the clamp 22 and the advancing movement of the slider holder 11 are performed by separate actuating systems. The slide 10 extends through the top portion of the base 4 and has, at the other end remote from the slider holder 11, a downwardly directed projection 34 (which is corresponding to the stop 16 of the first embodiment). A compression spring 35 is mounted between the projection 34 and the base 4 to normally urge the slide 10 to its retracted position. The base 4 has a through-hole 36 in which the slide 10 is received, and a guide slot 37 extending along the through-hole 36. The slide 10 has on its lower side a projection 38 slidably received in the guide slot 37. The range of movement of the slide 10 is limited to the length of the guide slot 37.

The upper clamp member 23 has a support pin 39 from which an endless rope 33 is hung for pulling the upper clamp member 23 downwardly against the bias of the compression spring 27.

In use, the leading ends of the opposed stringers F1, F2 are threaded through the slider S retained in the slider holder 11 and then are laterally aligned by the aligning means 19, whereupon the upper clamp member 23 is pulled downwardly by the rope 33 to hold the leading ends of the opposed stringers F1, F2 in their aligned position. Subsequently, with the leading ends of the opposed stringers F1, F2 thus clamped, the slide 10 is pushed to its advanced position against the bias of the compression spring 35. Thereafter, when they are freed from those pulling and pushing forces, the upper clamp member 23 and the slide 10 are returned to their original position under the bias of the compression springs 27, 35, respectively.

Figure 10:
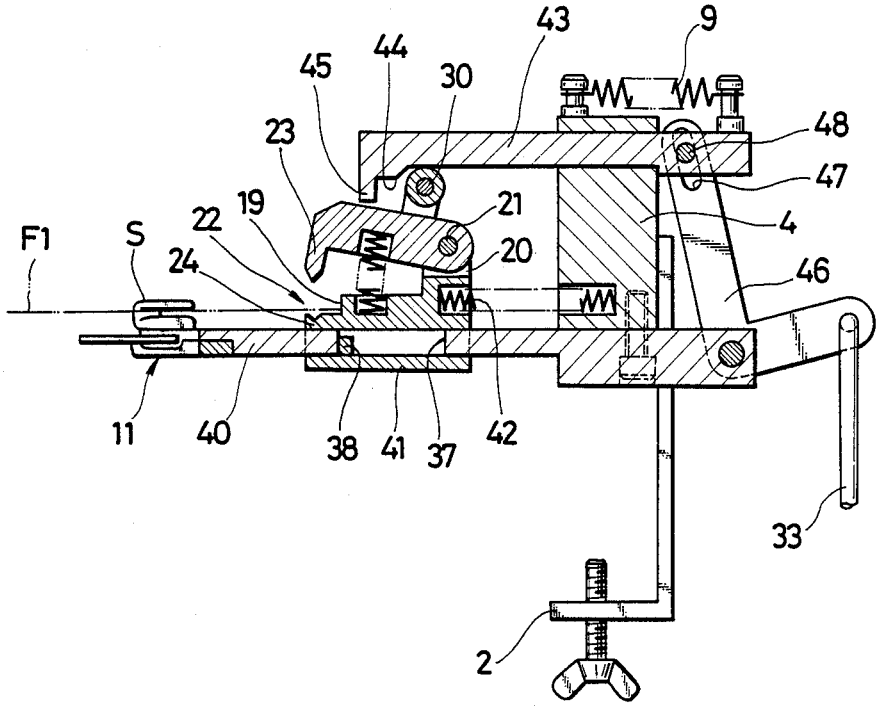
FIG. 10 shows a third embodiment.
Figure 11:
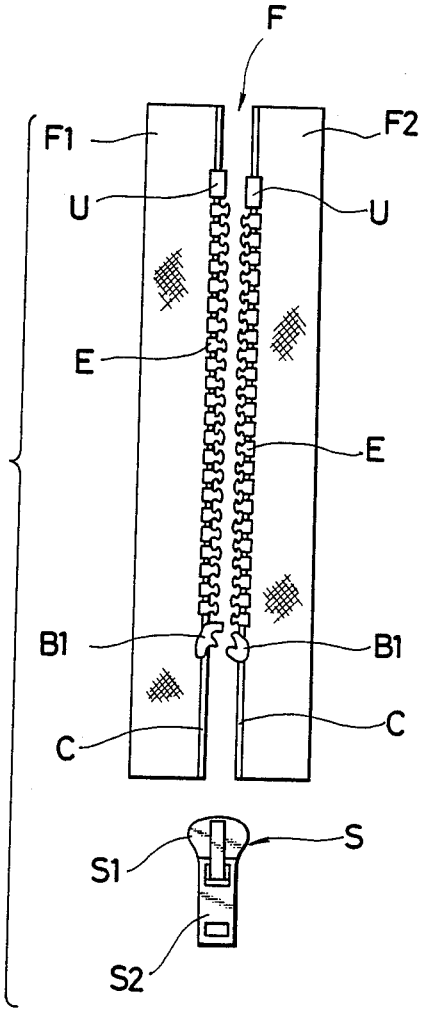
FIG. 11 is a plan view of a disassembled slide fastener having a separable bottom stop.

FIG. 10 shows a third embodiment in which the slider holder 11 is stationary and the clamp 22 is movable away from the slider holder 11. The slide holder 11 is provided on one end of an elongated arm 40 fixed to the base 4. A sliding member 41 is slidably mounted on the arm 40 and has a stop pin 38 slidably received in a guide slot 37. The range of movement of the sliding member 41 is limited to the length of the guide slot 37. The sliding member 41 is normally urged toward the slider holder 11 by a compression spring 42. The stringer aligning means 19 and the clamp 22 are provided on the top of the sliding member 41. A cam follower roller 30 is supported on the top of the upper clamp member 23.

An actuating member 43 is slidably mounted on the upper portion of the base 4 and is normally urged toward the slider-holder side by an extension spring 9. The advancing movement of the actuating member 43 is restricted by a stepped portion formed at the rear end portion of the actuating member 43. At its front end portion the actuating member 43 has a cam surface 44 facing downwardly and engageable with the cam follower roller 30 supported on the upper clamp member 23 and a downwardly directed projection 45 contiguous to the cam surface 44 and also engageable with the follower cam roller 30. A pivot pin 48 is mounted on the rear end of the actuating member 43 and is received in a longitudinal slot 47 formed in one end of a bell crank 46. The rope 33 is hung from the other end of the bell crank 46.

In use, the leading ends of the opposed stringers F1, F3 are threaded through the slider S retained in the slider holder 11 and then are laterally aligned by the aligning means 19, whereupon the rope 33 is pulled downwardly to move the actuating member 43 rearwardly against the bias of the extension spring 9. As a result, the upper clamp member 23 is moved downwardly to hold the leading ends of the opposed stringers F1, F2 as the cam follower roller 30 rolls on the cam surface 44. With continued rearward movement of the actuating member 43, the sliding member 41 together with the aligning means 19 and the clamp 22 are moved toward the base 4 until the male and female bottom stop halves B1, B2 and several endmost fastener elements E, E are coupled. Thereafter, when the rope 33 is freed from the downward pulling force, the actuating member 43 is returned to its advanced position under the bias of the spring 9, thus allowing the sliding member 41 together with the aligning means 19 and the clamp 23 to be returned to their advanced position under the bias of the spring 42. Also the upper clamp member 23 is returned to its raised position as the cam follower roller 30 is released from the cam surface 44 and the projection 45 of the actuating member 43.

According to the present invention, partly because the leading ends of the opposed stringers threaded through a slider are laterally aligned by the aligning means and are held by the clamp in their aligned position, and are then drawn from the slider, by relatively moving the slider holder and the clamp away from each other, until the male and female bottom top halves and several endmost fastener elements are coupled, it is possible to thread a slider onto the opposed stringers easily and reliably without any divergence or miscoupling of the stringers.

Although various minor modifications may be suggested by those versed in the art, it should be understood that I wish to embody within the scope of the patent granted thereon, all such embodiments as reasonably and properly come within the scope of my contribution to the art.

What is claimed is:

1. An apparatus for threading a slider onto a pair of stringers for a slide fastener, comprising:
   (a) a slider holder disposed in a longitudinal path of the pair of stringers;
   (b) aligning means disposed downstream of said slider holder in the longitudinal path for laterally aligning respective leading ends of the opposed stringers with each other which stringers have been threaded through the slider; and
   (c) a clamp disposed between said slider holder and said aligning means for holding the opposed stringers in their relative position, said clamp and said slider holder being relatively movable away from each other along the longitudinal path of the stringers.

2. An apparatus according to claim 1, in which said clamp and said aligning means are stationary, and said slider holder is movable away from said clamp and said aligning means.

3. An apparatus according to claim 2, further including a fixed base on which said aligning means and said clamp are disclosed, an elongated slide which is longitudinally slidably mounted on said base and on which said slider holder is disposed.

4. An apparatus according to claim 3, in which said aligning means includes a stepped portion formed on a top of said base and having an upright surface against which the leading ends of the opposed stringers are to abut.

5. An apparatus according to claim 3, in which said clamp includes an upper clamp member pivotally mounted on the top of said base, a lower clamp member formed on the top of said base at a position between said aligning means and said slider holder, and a first spring normally urging said upper clamp member upwardly away from said lower clamp member.

6. An apparatus according to claim 5, further including means for moving said upper clamp member downwardly toward said lower clamp member against the bias of said first spring.

7. An apparatus according to claim 6, in which said upper-clamp-member moving means includes a support pin mounted on said upper clamp member, and an endless belt hung from said support pin for pulling said upper clamp member downwardly.

8. An apparatus according to claim 7, in which said slide is normally urged toward its retracted position by a second spring.

9. An apparatus according to claim 5, further including means for moving said upper clamp member downwardly toward said lower clamp member against the bias of said first spring and also for moving said slide in such a manner that said slider holder is moved away from said clamp.

10. An apparatus according to claim 9, in which said moving means includes a pair of parallel cam plates substantially vertically movably supported one on each side of said base and each having a cam slot, a third spring normally urging each said cam plate upwardly, an endless belt hung from said cam plates for pulling the latter downwardly against the bias of said third spring, an upright projection extending from said upper clamp member and having on its top end and also on its downstream side a cam surface, a follower roller supported between said cam plates and engageable with said cam surface so as to push said upper clamp member downwardly toward said lower clamp member against the bias of said first spring as said cam plates are pulled downwardly, and a pair of follower pins mounted on the other end of said slide and each movably received in said cam slot, said cam slot being of a dogleg shape having a lower portion extending perpendicularly to the direction of movement of said slide, and an upper portion inclined toward said slider holder.

11. An apparatus according to claim 1, in which said slider holder is stationary, and said clamp and said aligning means are movable away from said slider holder.

12. An apparatus according to claim 11, further including a fixed base, an elongated arm which is fixed to said base and on which said slider holder is disposed, a sliding member which is slidably mounted on said arm and on which said aligning means and said claim are disposed.

13. An apparatus according to claim 12, in which said clamp includes an upper clamp member pivotally mounted on a top of said sliding member and normally spring-biased upwardly, and a lower clamp member formed on the top of said sliding member at a position between said slider holder and said aligning means.

14. An apparatus according to claim 13, further including means for moving said upper clamp member downwardly toward said lower clamp member and also for moving said sliding member away from said slider holder.

15. An apparatus according to claim 14, in which said moving means includes an actuating member slidably mounted on said base and having at one end a downwardly facing cam surface and a downwardly directed projection contiguous to said cam surface, a bell crank pivotally connected at its upper end to the other end of said actuating member and at its lower end to a pulling rope for moving said actuating member away from said slider holder, and a cam follower roller supported on said upper clamp member and engageable with said cam surface and said projection as said actuating member is moved away from said slider holder.

* * * * *